US007905037B1

(12) United States Patent
Holland et al.

(10) Patent No.: US 7,905,037 B1
(45) Date of Patent: Mar. 15, 2011

(54) CUSTOMIZABLE UNIVERSAL-FIT DRINKMARKER

(76) Inventors: Shannon N. Holland, Aurora, IL (US); Christine S. Holland, Aurora, IL (US)

( * ) Notice: Subject to any disclaimer, the term of this patent is extended or adjusted under 35 U.S.C. 154(b) by 0 days.

(21) Appl. No.: 12/654,188

(22) Filed: Dec. 14, 2009

Related U.S. Application Data

(60) Provisional application No. 61/193,655, filed on Dec. 12, 2008.

(51) Int. Cl.
*G09F 3/14* (2006.01)

(52) U.S. Cl. ..... 40/310; 206/459.5; 220/737; 220/694

(58) Field of Classification Search ..... 206/459.5, 206/443; 40/306, 310, 665; 220/694, 720, 220/737–738
See application file for complete search history.

(56) References Cited

U.S. PATENT DOCUMENTS 1,478,896 A * 12/1923 Ferency ..... 40/310
1,666,859 A * 4/1928 League ..... 40/652
3,028,189 A * 4/1962 Gialanella ..... 294/87.2
3,339,814 A * 9/1967 Carbine ..... 294/160
4,759,139 A 7/1988 Ricks
5,358,770 A 10/1994 Evans
5,655,805 A * 8/1997 Shaddy ..... 294/31.2
5,704,144 A 1/1998 Groth
5,735,562 A * 4/1998 Borg ..... 294/87.2
2001/0054817 A1 12/2001 Kelley et al.
2002/0117418 A1* 8/2002 Shrader ..... 206/459.1
2003/0230019 A1* 12/2003 Olivera ..... 40/665
2004/0128877 A1 7/2004 Luedde
2004/0195254 A1 10/2004 Bunkers
2005/0229449 A1 10/2005 Shepley
2008/0087677 A1* 4/2008 Robertson et al. ..... 220/694
2009/0008525 A1* 1/2009 Chekroune ..... 248/312
2009/0084701 A1* 4/2009 Isserow et al. ..... 206/459.5
2009/0094870 A1* 4/2009 Isserow et al. ..... 40/306
2009/0178313 A1* 7/2009 McManigal ..... 40/310
2009/0293328 A1* 12/2009 Bull ..... 40/310

* cited by examiner

*Primary Examiner* — J. Gregory Pickett
*Assistant Examiner* — Robert Poon
(74) *Attorney, Agent, or Firm* — Donald Grant Kelly

(57) ABSTRACT

A wearable drinkmarker element fitting a variety of beverage containers and customizable to depict individual ownership for health considerations. The element includes inner ribs configured to engage containers and affording space for condensation flow away from rib gripping areas. The element is fabricated from a flexible material and configured in a substantial C-shape defining an interior space where a container is embraced. The element is flexible with memory to embrace the container when spread apart for mounting thereon. The ribs are slightly tapered to promote proper adherence to containers, and have sloped or inclined surfaces at their upper ends to accommodate container placement. The ribs may extend inwardly individually or be interconnected by an inner rim, affording stability in use and comfortable wrist wear by the user when not placed on a container. Finally, outwardly curved ends of the element allow for easy placement and removal of the drink marker.

2 Claims, 2 Drawing Sheets

CUSTOMIZABLE UNIVERSAL-FIT DRINKMARKER

CROSS-REFERENCE TO RELATED APPLICATIONS

All priority benefits under 35 USC 119(e) of Provisional Patent Application Ser. No. 61/193,655 filed Dec. 12, 2008 are hereby claimed and the contents thereof in their entirety incorporated herein by reference.

STATEMENT REGARDING FEDERALLY SPONSORED RESEARCH OR DEVELOPMENT

Not applicable

REFERENCE TO SEQUENCE LISTING

Not applicable

BACKGROUND OF THE INVENTION

1. Field of the Invention

The present invention generally relates to individualized markers for drinking vessels such as cups, glasses, bottles and the like. More particularly the present invention addresses concerns for inadvertent transmission of germs, bacteria and contagious infections through sharing of a drinking vessel by providing a unique container-marking device and system featuring customizable universal-fit marker elements.

This invention specifically relates to a common problem of beverage identification confusion, particularly in a social setting where multiple people are consuming beverages. Such occasions may include work settings, parties, family gatherings, sports or exercise activities, social events, weddings, health clubs or other gatherings where people interact and beverages are consumed from vessels or containers. The present invention enjoys added advantage in that its configuration presents dual application as both a drinkmarker and bangle-type bracelet (handy when needed for drink marking application).

There are many obvious problems associated with lack of personal identification or ownership of an individual's drink, exacerbated a common human practice of simply accepting or ignoring the hazardous consequences. The problems include (a) the unfortunate prospect of transmitting or receiving communicable diseases, (b) general hygiene issues, and (c) waste of beverages when confusion of beverage ownership is found to exist and an unfinished drink is abandoned or tossed. With increased media focus and public anxiety over the prospect of inadvertent or careless transmission of H1N1, herpes, HIV, cold sores, tuberculosis, hepatitis B and the like, the marking or personalization of drinking containers has become a global public health issue. Yet, technology-inclined nations continue to ignore a very common transmission vehicle: shared drink containers.

2. Description of Related Art

A number of patented inventions relate to the above mentioned problem. However, the prior art patents fail to practically, safely, efficiently, and aesthetically solve the problem. Many of the previous patents for drink markers have limited utility with respect to incorporating them on differing sized and shaped beverage containers (i.e. water bottles, soda cans, and tapered disposable soda/coffee containers). In other words, existing drink markers lack universality.

Besides, many of existing patented devices ostensibly addressing the problem are difficult to use/apply to beverage containers and equally difficult to maintain their position on the containers. In some cases, the devices are prone to slipping down and/or off tapered cups. Others would likely malfunction due to condensation forming on beverage container at the point of marker contact. Additionally, some marking devices appear difficult to customize for easy identification. This is due in part to the nature of the material proposed for marker fabrication. For these reasons, drink markers are not commonplace. The following are patented or patent-pending examples drawn from a cursory patent literature review.

Bunkers' Published US Patent Application No. 20040195254, titled "Method and Device for Identifying an Individual Container," would be difficult to apply onto a container filled with hot coffee/tea without risk of spillage and potential skin burns. In order to apply it to a hot beverage, one would have to use both hands to stretch the elastic band over the top of the container, then lower down and release elastic band onto the drink container—without tipping or spilling hot liquid. Customization with one's name using stickers or decals (economically) would likely fail due to the elastic nature of the band.

Published US Patent Application No. 20010054817, filed by Kelley et al. and titled "Method & Device for Identifying Drinkware," would likely fail on tapered beverage containers due to its design (a flat band with adhesive/snap-on ends). Condensation would likely further contribute to this design's failure due to slippage on container/can surface.

The Evans U.S. Pat. No. 5,358,770 (Oct. 25, 1994) titled "Device for Releasable Identifying Objects," is similar in concept to the present invention in certain respects. However, the patented band has "a smooth interior surface" that lacks traction capability and thus would tend toward downward slippage on tapered beverage containers and condensation would further promote this problem.

U.S. Pat. No. 5,704,144 (Jan. 6, 1998) granted to Groth and titled "Beverage Container Identification Tag" would likely fail on tapered beverage containers due to its design including a flat band with adhesive ends.

Ricks received U.S. Pat. No. 4,759,139 (Jul. 26, 1988) titled "Baby Bottle Identification Collar" which requires the collar to be held in place by a nipple cap. This invention obviously fits only bottles the size/diameter of the collar (not adjustable sizes) and with specifically shaped nipple caps.

Shepley filed US Patent Application No. 20050229449, titled "Method and Apparatus for Identifying a Container." It appears that the Shepley container identifier would likely fail on tapered beverage containers due to the nature of the marker design—a flat band with fastener mechanism.

US Patent Application 20040128877 granted Jul. 8, 2004 and filed by Luedde and titled "Beverage Container Identification Method, System, and Device," has inherent design issues similar to many of the above patent designs including difficulty applying it onto hot beverage containers. It also would be difficult to obtain a secure fit onto a tapered cup as it is likely to fail on tapered beverage containers due to its design. This patent document and all others discussed hereabove are incorporated by reference herein as pointed out in Paragraph 49, below.

Each of the above-referenced patents and published patent applications listed as "Related Art" was, in its entirety, incorporated by reference thereto in the above noted provisional patent application to which priority benefits are claimed herein.

So far as known to Applicant, no drinkmarker/beverage identifier previously patented or developed provides a universal solution for various beverage containers (such as water bottles, soda cans, disposable coffee cups/containers, glasses, mugs, baby bottles, sippy cups, and the like) while having ease of application to beverage container and ease of customization for easy identification.

For the record, the compound descriptor "drinkmarker" is used in the present context as a noun to designate the inventive article, and more specifically to call attention to the function of the device as conveying a distinguishing relationship between an individual and her/his drink with respect to nearby drinks physically associated with others. The inventive device, for reasons that will be apparent, may be referred to as a wearable drinkmarker or marker device. Although drinkmarker is not to be found in typical dictionaries, the USPTO's *Manual of Patent Examining Procedure*, at MPEP 2111.01, points out that an applicant may be her/his own lexicographer. In defining their own terms, applicants need only do so with reasonable clarity, deliberateness, and precision, and set this out within the disclosure. Finally, it is noted that the name DRINKMARX™, also may be found within the four corners of this application, is asserted as a trademark owned and used by applicants in distinguishing the marker brand.

SUMMARY OF INVENTION

The invention, an improved drink marker, is a marking or tagging appliance fabricated or otherwise formed into substantially a C-shaped element. The element has an external display surface where indicia or other symbols may be applied, for example decals or stickers depicting user's initials and/or symbols indicative of a user's affinity (school, fraternity, sorority etc.). The C-shaped element is curved about a generally central axis, thereby defining an interior space suitable for mounting on and about a container surface and/or user's wrist, ankle and the like. A gap remains between spaced-apart terminal ends of the element.

The element is flexible in nature, i.e., fabricated with flexible shape-recovery memory. This allows the element to be forcefully spread apart at its first and second terminal ends, expanding to an extent necessary for application about a container, then released so as to grip said container due to its flexible memory. The C-shaped terminal ends curve or angle outwardly away from the central axis and interior space so as to allow for easy manipulation and application from side, top, or bottom of beverage container.

The substantially C-shaped appliance is sufficiently flexible to accommodate variable circumference beverage containers. Slight outward contours at the terminal ends of the novel drink marker further enable easy removal of the drinkmarker from beverage container using only the fingertips. Pressure mildly applied serves to spread these terminal ends such that they accept a container and then recover their shapes via structural memory to close around the container. The C-shape contour with outwardly curved terminal ends facilitates a forced-spreading of the terminal ends when pressed against a glass, cup, bottle or the like.

The inner surface of the C-shape drink marker includes at least one but perhaps multiple raised pads or ribs which can be constructed to include a slightly adherent or otherwise frictional material such as rubber, natural cork, synthetic polymer such as a thermoplastic elastomer (TPE) and the like affording an adherence, non-slip or gripping effect (via friction fit) relative to a beverage container and the like. As will be shown, an alternative embodiment features pad elements mutually interconnected by a relatively narrow, inner ledge, rim or raised land which may be integral with the ribs or pads and/or the C-shaped marker. The inner raised rim has been found to increase marker stability by limiting toggle or rocking motion when mounted on a container. This raised rim offers ancillary benefit in that the C-shaped drink marker may be more comfortably worn as a bangle since the ribs or pads are less likely to press into the wearer's flesh.

The aforementioned pads or ribs may be slightly, inwardly tapered downwardly (from adjacent an upper edge of the drink marker as applied to a container and toward its lower edge) so as to promote drink marker adherence or frictional interference to typically tapered beverage containers. This configuration also serves to prevent downward slippage of the drink marker appliance. The pads/ribs are more easily mounted on containers from a lower end of said containers if each pad/rib includes a first inwardly sloping guide surface joining a second inwardly sloping container-engagement surface. Relative to the central axis of the C-shaped element, the inward slope of the guide surface is greater than the inward slope of the container-engagement surface. Again, as noted above, the drink marker device also may be simply pressed against a container such that the terminal ends of the device spread to grasp the container surface.

Spaces between the pads (which are applied or integrally formed in an array within an inner surface of the substantially C-shaped appliance) may allow condensation to flow between the drink marker and beverage container and away from the upper gripping extent of each pad, so as not to compromise adherence of the drink marker. The outer surface of the drink marker presents sufficient open space to fully customize the drink marker with alpha-numeric characters, symbols, and/or clip art stickers or other indicia. As noted above, this inventive appliance device, when not deployed for drink marking, may be conveniently worn on wrist, arm, or ankle both as a fashion statement, affinity designation or simply as temporary storage.

Figure 1:
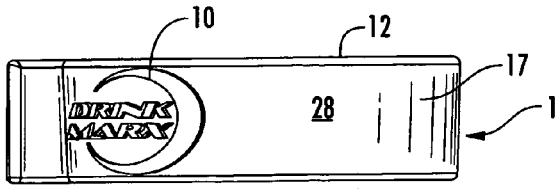
FIG. 1 is an orthographic side view of the present invention depicted in its naturally relaxed, unflexed or non-applied state.

With respect to the drawing figures just described, it is important to note that while the drawings are drawn to scale, relative dimensions depicted are not to be considered as limiting in any manner the range of configurations that naturally will fall under the scope of the present invention. In other words, for example, the drink marker appliance may be significantly wider or narrower. Similarly, the number and configuration of the pads and the extent of end portion contours may be considerably different from that depicted.

REFERENCE NUMERALS CORRESPONDING TO PARTS

Embodiments 1 and 2 (or 1/2)

1/2 drinkmarker appliance or device
10/20 product logo
12/32 upper edge of drinkmarker
14/34 lower edge of drinkmarker
15/35 C-shape configuration
16/36 inner surface of drinkmarker
17/37 outer surface of drinkmarker
18/38 contoured portions at appliance terminal ends
20/40 drink marker appliance terminal end
21/41 pad upper end
23/43 pad lower end
24/42 slightly tapered pad
26/46 drainage space between adjacent pads
/44 ledge, land or internally raised rim
28/48 open space for personal customization

DETAILED DESCRIPTION OF THE INVENTION

As illustrated by example in FIG. 1, the drinkmarker appliance 1 may have a certain overall diameter to be determined by its intended use (e.g., for application about a bottle, can, cup, or other beverage container). Larger and/or smaller diameters may of course be necessary to fill a comprehensive commercial line of drinkmarker devices such that containers of all sizes can be accommodated. In reality, as evidenced by ubiquitous drink vending machines, coffee shops and the like, drink containers generally are found to be sized within a generally common range of diameters and often with sloping or tapered profiles.

The illustrated examples are in no way intended to limit the scope of the invention since it is recognized that some applications may call for a larger or smaller size. Further, the secondary use of this device as personal decorative wear (e.g., as wrist or ankle bangle/bracelet, or even as oversize earrings) also is not limited in scope by examples presented in the accompanying illustrations.

The inventive appliance or element 1 is viewed as including an upper edge 12 and lower edge 14. In the present context, directional reference to upper and lower portions of the element 1 is merely to facilitate the invention description process. Obviously, such a drink marker element 1 may exist or be applied in any number of positions such that the designated upper edge 12 may in fact be in a lower position. The outer surface 17 is seen as having a relatively broad open space 28 which may be used for marking, inscribing, applying decals and stickers, or otherwise identifying a relationship with an individual user. Further, a portion of the open space 28 of outer surface 17 may be dedicated to a company or association logo and other affinity design or insignia as may be appropriate.

Figure 2:
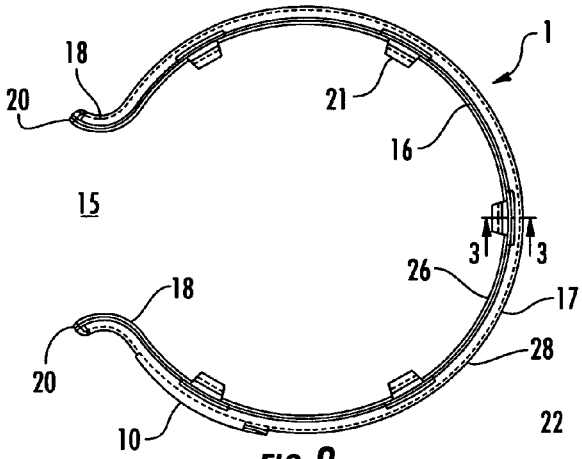
FIG. 2 is an orthographic plan view of the present invention, also depicted in its naturally relaxed, unflexed or non-applied state.
Figure 3:
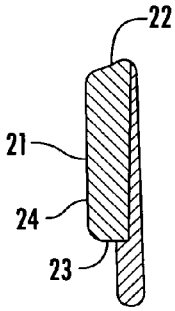
FIG. 3 is a cross-sectional view of the drink marker appliance and tapered spacer pad taken at Section 3-3 of FIG. 2.

The inventive drinkmarker appliance or device 1 is clearly seen in FIG. 2 as having a substantially C-shape 15 (i.e. an arcuate member curved about a generally central axis and with a surface defined by a generally constant radius, and having an open or discontinued zone or portion along its circumference). More specifically, the substantially C-shaped 15 device 1 is slightly flexible, with spaced-apart terminal ends 20 at the terminus of outwardly contoured portions 18.

Contoured portions 18 are seen to be curving away from the drinkmarker's defined inner space. These contoured portions 18 enable a snap-on action as the device 1 is applied to a container body (not shown). Pressure on portions 18 serves to slightly flex device 1, somewhat bending the C-shaped 15 device 1 to a more open condition so as to accept and accommodate device 1 engagement with the container (not shown). The relative flexibility of device 1 may be sufficient to permit single-handed application to a container by pressing contoured portions 18 against a container lateral surface. Constructed of a material with elastic memory, the device 1 then opens and retracts to accept and firmly grip the container.

Along the inner surface 16 of drinkmarker device 1, gripping ribs or pads 21 are strategically located so as to provide gripping points of engagement, as well as a space between device 1 and its engaged container surface. The space afforded by the inwardly projecting pads 21 permit container condensation (not shown) to pass away from the ribs 21 between the device 1 and its embraced container to avoid defeat of the device 1 grip or traction against the container surface being held. Though not illustrated, it is possible that a single spacer pad 21 could collaborate with device 1 ends 20 at contoured portions 18 to effectively provide the desired grip. Illustrated in FIG. 2 are five spacer pads 21, but it will be appreciated that this number is not to be considered limiting the invention scope since more or fewer pads 21 can be employed.

Figure 4:
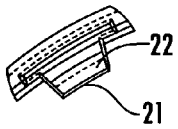
FIG. 4 is a plan view of one of the tapered spacer pads depicted as applied to the drink marker appliance.
Figure 5:
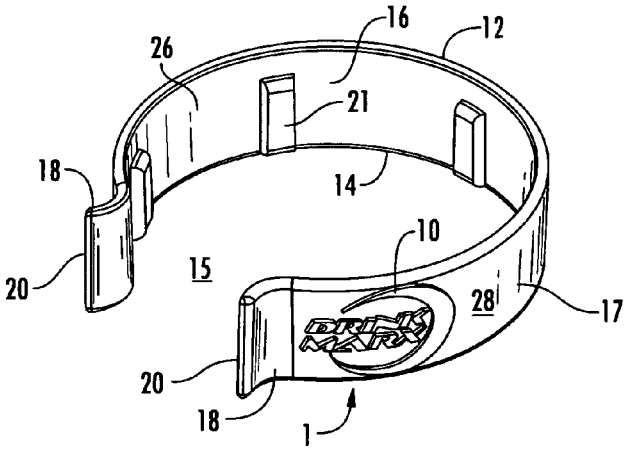
FIG. 5 is a top perspective view of the present invention viewed from the open end of its substantially C-shaped configuration.

Another distinctive feature of each rib/pad 2, as best seen in FIGS. 4 and 5, is its slight inward sloping surface 24 from pad upper end 22 downwardly toward pad lower end 23. This facilitates device 1 engagement with tapered containers (not shown). To enable enhanced traction or gripping of the device 1 through its pads 21, the latter may be fabricated or formed, at least in part, of high friction material such as rubber, natural cork, synthetic polymer such as a thermoplastic elastomer or the like.

FIG. 5 is a perspective view of the drinkmarker appliance or device 1 in position for application. A user for the present invention might be someone attending a public gathering, picnic, party, or exercise facility and the like where beverages are being consumed. To avoid picking up someone else's container, the user produces the drinkmarker appliance or device 1 (perhaps removed from the user's wrist or from a complementary collection nearby) and snaps it onto a container. The device 1 may be pre-marked with a personal identifier or a set of identifier stickers could be made available (perhaps as part of a drinkmarker device 1 kit, not shown) from which the user may select a unique identifier. Identifiers, of course, can be affinity types associated with organizations and institutions.

Use of device 1 will help to prevent the spread of germs and contagious maladies. It will help the user avoid unexpectedly or accidentally drinking unwanted liquids which for health-related reasons (such as diabetes or alcoholism) may be harmful when consumed. The configuration of the open space 28 affords adequate identification area; the pads 21 are fabricated and configured to better engage and grip a container, and spaced so as to afford condensation passage therebetween. Contoured portions 18 of device 1 terminal ends 20 afford ease of application and removal.

The invention could be made from a variety of materials and presented in a variety of sizes (circumference, width, thickness). The invention could also be in various shapes or configurations such as a partial circle (e.g., C-shaped as shown), or octagon, hexagon, and oval shapes. Materials for production of the device 1 and ribs/pads could be polypropylene deployed through an injection molding process or any other material that would allow adequate flexibility and memory traits for proper function. Customization could be via alpha numeric stickers, clip art stickers, or other indicia.

The substantially C-shaped 15 drink marker 1 can be easily applied from above, below, or side of beverage container (not shown). The substantially C-shaped 15 device 1 is flexed open as it is pressed against said container where it remains due to the elastic memory of the marker 1. Alternatively, the drink marker 1 may be initially spread apart, e.g., by hand, and positioned or snapped about said container. Once the drinkmarker 1 is in position around the beverage container, the drink marker 1 will contract to engage the container forming a circumferential friction fit around the beverage container.

The drink marker device 1 can easily be adjusted upward or downward on said beverage container to desired position by slightly opening (spreading) the device 1, raising or lowering the drinkmarker device 1, then allowing it to contract onto the beverage container. Removing the drinkmarker device 1 is easily accomplished by simply grasping the flanged ends of the C-shaped 15 drinkmarker device 1 and gently opening the device 1, allowing removal from the side, top, or bottom of beverage container. Alternatively, the drinkmarker 1 may be slid upwardly or downwardly for removal.

A slightly different, second embodiment of the present invention is illustrated in FIGS. 6-13. Drink marker 2 is viewed in FIG. 6 as having an upper edge 32, lower edge 34, C-shape configuration 35 including an open marking or labeling area 48 on surface 37 easily accommodating personal customization. Similar to drink marker element 1, the drink marker 2 may display a logo such as that shown at 30. Further, drink marker element 2 includes an upper and lower edge 32 and 37, and terminal ends 40 at contour portions 38 of C-shape configuration 35. (The terms "upper" and "lower," in this context are merely relative terms to facilitate the description. These defined edges may, of course, be reversed in use.)

Figures 6, 7, 8, 9, 10, 11, 12, 13:
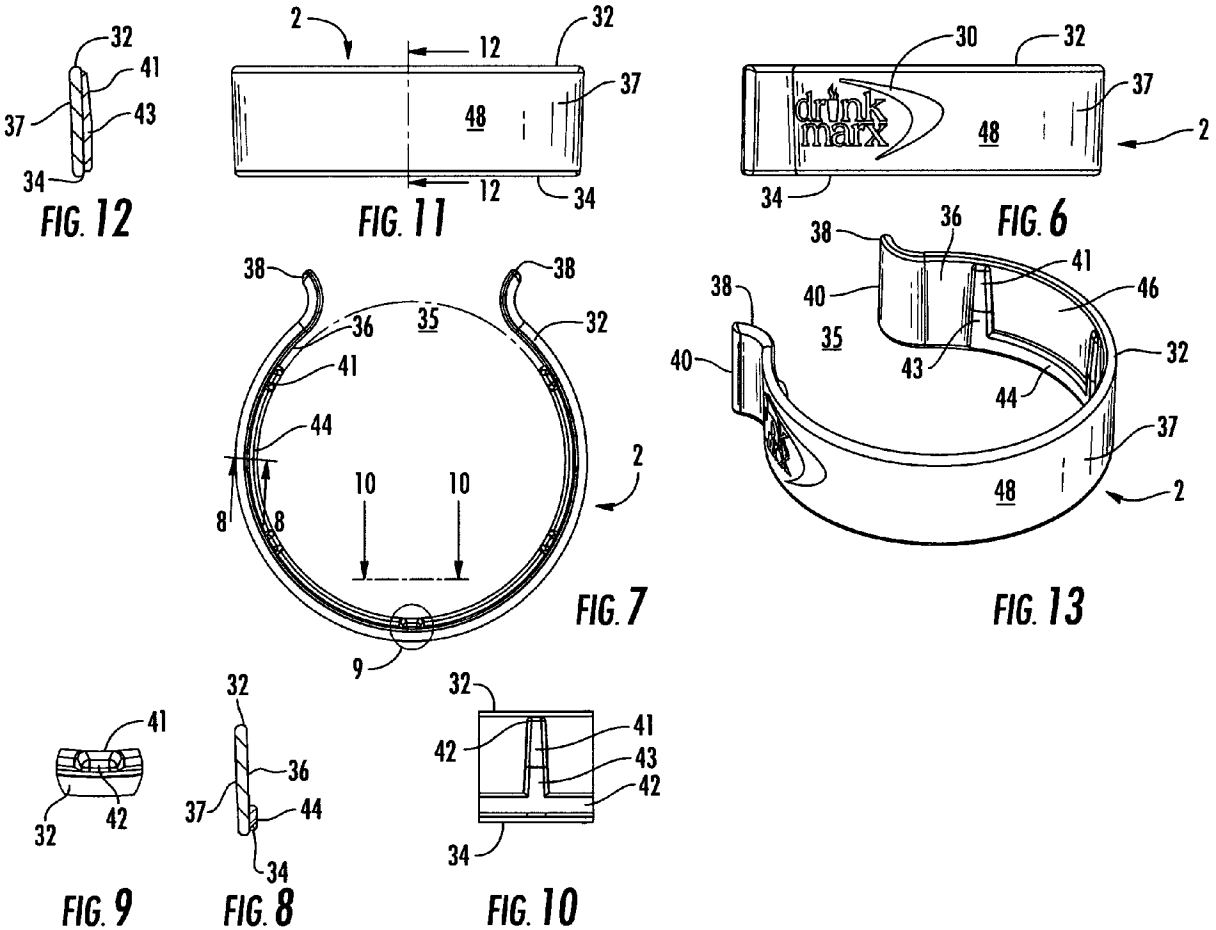
FIG. 6 is an orthographic side view of a second embodiment of the present invention depicted in its naturally relaxed, unflexed or non-applied state.
FIG. 7 is an orthographic plan view of the second embodiment of the present invention, also depicted in its naturally relaxed, unflexed or non-applied state.
FIG. 8 is a cross-sectional view of a side of the second embodiment of the present invention taken at section 8-8 of FIG. 7.
FIG. 9 is an expanded detail view with respect to detail 9 as correspondingly designated in FIG. 7.
FIG. 10 a partial orthographic view of an inside surface of the second embodiment of the invention taken from perspective view 10-10 in FIG. 7 and illustrating details of the invention internal surface.
FIG. 11 is an orthographic end view of an outer surface of the C-shaped marker configuration opposite spaced apart terminal ends thereof.
FIG. 12 is a cross-sectional view of the present invention taken at section 12-12 on FIG. 11.
FIG. 13 is a top perspective view of the alternative embodiment of the present invention.

In FIG. 7, internal pads or ribs 41 are spaced along the interior 36 but, unlike the first embodiment, these pads 41 are interconnected at their lower portions 43 by a ledge, land or internally raised rim 44 extending inwardly to a level coextensive with pad 41 lower portion 44 to form a continuous inner surface as shown in FIGS. 8 and 13. The raised rim 44 serves to help stabilize the marker element 2 when mounted on a container, keeping the marker 2 from a rocking or toggling motion. Rim 44 has further advantage when the marker device 2 is, for convenience and preparedness, worn as a bangle since the continuous inner surface is more comfortable.

As depicted in the FIG. 12 sectional view taken at section 12-12 of FIG. 11, said substantially C-shaped element 2 has a top edge 32 and bottom edge 34 each substantially coextensive with said element 2. Each pad 41 has an upper portion thereof surface and a lower portion surface 43. Said lower portion surface 43 extends generally parallel to said generally central axis. Said upper portion is sloped upwardly from lower portion 43 and outwardly of said generally central axis toward top edge 32 of drink marker device 2. This sloping feature, also seen in the FIG. 9 (referenced from FIG. 7), facilitates a wedging fit between the pad 41 upper surface and its associated container, so as to form a generally upwardly facing container support surface.

The profile of internal pads 41 is viewed as relatively slim in the FIG. 12. The lower portion 43 is slightly thicker in cross-section to present a wedging effect on a container placed therein. As in the previously embodiment the spacing 46 between pads 41 facilitates drain condensation (not shown) away from the pad 41 engagement area with containers.

As noted, the inventive device disclosed herein may be fabricated or formed in a variety of ways and from a variety of materials. The various parts may be machined, molded or otherwise fabricated from plastic, recycled plastic, or wood, or be manufactured from a combination of any suitable materials and processes. The choice of materials and construction are clearly within the scope of the invention to be claimed.

Upon carefully reviewing the foregoing specification along with the accompanying drawings it will be evident that this invention is susceptible of modifications, combinations, and alterations in a number of ways which may differ from those set forth.

Each of the above-referenced patents and published patent applications listed as "Related Art" was in its entirety incorporated by reference thereto in the above referenced provisional patent application to which priority claim is made.

We claim:

1. A wearable drink marker device for container identification, said device characterized as comprising;

a substantially C-shaped element with an external display surface and internal engagement surface curved about a generally central axis, and defining an interior space;

said element includes a top and bottom edge generally coextensive with said element;

said element constructed at least in part of a generally flexible material with shape-recovery memory;

said element further defined as including spaced-apart first and second terminal ends configured to be spread apart for optional placement on a container or wearer's body part disposed within said interior space;

said first and second terminal ends including opposed portions of said element having a configuration curved outwardly from said interior space;

the internal engagement surface including multiple spaced apart pads extending generally parallel to said generally central axis;

each of said pads includes an internal face with upper portion surface and a lower portion surface wherein said pad upper portion surface is sloped upwardly from said pad lower portion surface and outwardly of said generally central axis toward said substantially top edge so as to form a generally upwardly facing container support surface, and said pad lower portion surface extends generally parallel to said generally central axis;

said multiple spaced-apart pads are interconnected at said lower portion thereof by an internal raised rim extending inwardly of said internal face and generally parallel to said generally central axis so as to form a substantially continuous, relatively smooth surface with said pad lower portion surface so as to be stabilized when placed on said container surface and worn comfortably by a user when said device is not used for container identification;

whereby said wearable drink marker device may be placed on an exterior surface of a container by spreading apart said opposed portions and permitting said opposed portions to recover their shape to grip said container therein and each said sloped upper portion surface aids in gripping said container by wedging interference fit against said container surface, while permitting condensation therefrom to flow away from between said pads.

2. The wearable drink marker device of claim 1 wherein said external display surface is configured to afford space for attachable indicia for container user identification purposes.

* * * * *